US007041995B2

(12) United States Patent
Eder

(10) Patent No.: US 7,041,995 B2
(45) Date of Patent: May 9, 2006

(54) LEAD SUBSTITUTE MATERIAL FOR RADIATION PROTECTION PURPOSES

(75) Inventor: Heinrich Eder, Munich (DE)

(73) Assignee: Mavig GmbH, Munich (DE)

( * ) Notice: Subject to any disclaimer, the term of this patent is extended or adjusted under 35 U.S.C. 154(b) by 0 days.

(21) Appl. No.: 10/509,774

(22) PCT Filed: Jul. 1, 2003

(86) PCT No.: PCT/DE03/02178

§ 371 (c)(1),
(2), (4) Date: Sep. 28, 2004

(87) PCT Pub. No.: WO2004/017332

PCT Pub. Date: Feb. 26, 2004

(65) Prior Publication Data

US 2005/0178986 A1 Aug. 18, 2005

(30) Foreign Application Priority Data

Jul. 26, 2002 (DE) ..... 102 34 159

(51) Int. Cl.
*G21F 1/00* (2006.01)

(52) U.S. Cl. ..... 250/515.1; 250/516.1; 250/505.1

(58) Field of Classification Search ..... None
See application file for complete search history.

(56) References Cited

U.S. PATENT DOCUMENTS

| | | | | |
|---|---|---|---|---|
| 5,245,195 | A | 9/1993 | Shah et al. | |
| 6,048,379 | A * | 4/2000 | Bray et al. | 75/229 |
| 6,153,666 | A | 11/2000 | Lagace | |
| 6,517,774 | B1 * | 2/2003 | Bray et al. | 419/65 |

FOREIGN PATENT DOCUMENTS

| | | |
|---|---|---|
| DE | 19955192 A1 | 5/2001 |
| EP | 0 371 699 | 6/1990 |
| EP | 0 372 758 | 6/1990 |
| JP | 54-151797 | 5/1978 |

* cited by examiner

*Primary Examiner*—Nikita Wells
(74) *Attorney, Agent, or Firm*—Scully, Scott, Murphy & Presser

(57) ABSTRACT

The invention relates o a lead substitute material for radiation protection purposes. The lead substitute material comprises Sn, Bi and optionally W or compounds of said metals and the composition of the lead-substitute material is a function of the nominal lead equivalent value.

5 Claims, 2 Drawing Sheets

LEAD SUBSTITUTE MATERIAL FOR RADIATION PROTECTION PURPOSES

The invention relates to a lead substitute material for radiation protection purposes in the energy range of an X-ray tube with a voltage of 60–125 kV.

Conventional radiation protection clothing for use in X-ray diagnosis usually contains lead or lead oxide as the protective material.

Substitution of other materials for this protective material is desirable for the following reasons, in particular:

On the one hand, lead and its processing entail a significant environmental impact and owing to its very large weight, on the other hand, lead necessarily entails a very large heavy weight of the protective clothing and therefore a great physical burden on the user.

For years, therefore, attempts have been made to find a substitute material for lead in radiation protection. The use of chemical elements with atomic numbers of from 50 to 76, or their compounds, has predominantly been proposed for this.

DE 199 55 192 A1 describes a method for producing a radiation protection material from a polymer as the matrix material and the powder of a metal with a high atomic number.

DE 201 00 267 U1 describes a highly elastic, lightweight, flexible, rubber-like radiation protection material, wherein additives of chemical elements with an atomic number greater than or equal to 50, and their oxides, are mixed with a special polymer.

To reduce the weight compared with conventional lead shields, EP 0 371 699 A1 proposes a material which likewise contains elements with high atomic numbers, in addition to a polymer as the matrix. A large number of metals are mentioned in this case.

Depending on the elements which are used, the attenuation factor or lead equivalent value (International Standard IEC 61331-1, Protective devices against diagnostic medical X-radiation) of the material in question shows a sometimes very pronounced dependency on the radiation energy, which is a function of the voltage of the X-ray tube.

The known radiation protection clothing made of lead-free material therefore has a more or less significant reduction in absorption compared with lead below 70 kV and above 110 kV. This means that, in order to achieve the same screening effect as for a material containing lead, a higher weight per unit area of the protective clothing is necessary for this range of the X-ray voltage.

The application range of commercially available lead-free protective clothing is therefore generally restricted.

In order to be able to substitute lead for radiation protection purposes, an absorption performance as close as possible to that of lead is necessary over a larger energy range, radiation protection materials usually being categorised according to the lead equivalent value and the radiation protection calculations often being based on lead equivalent values.

It is an object of the invention to replace lead as a radiation protection material with respect to its screening properties over an energy range of an X-ray tube with a voltage of 60–125 kV, that is to say over a larger energy range, and over a larger thickness range of the nominal lead equivalent values, while simultaneously achieving a weight reduction which is as great as possible. Only materials which are more environmentally friendly than lead are intended to be used in this case.

The object of the invention is achieved by a lead substitute material for radiation protection purposes in the energy range of an X-ray tube with a voltage of 60–125 kV, which is characterised in that the lead substitute material comprises Sn, Bi and optionally W, or compounds of these metals, and the composition of the lead substitute material is a function of the nominal lead equivalent value.

In order to achieve the object it was therefore necessary, on the one hand, to find a material selection for optimum screening properties over a larger energy range and, on the other hand, to find a material selection for a larger thickness range of the protective layer.

Preferred compounds of Sn, Bi and W are their oxides.

It is a fundamentally new and surprising discovery that, in order to achieve an optimum result, the composition of lead substitute materials varies as a function of the thickness of the protective material. A lead-free screening material with the extended application range can now be achieved by a combination of tin with bismuth and optionally tungsten, which is matched to the respective nominal lead equivalent value.

In a preferred embodiment of the invention, the lead substitute material is characterised in that it has 10–20% by weight of a matrix material, 50–75% by weight of Sn, or Sn compounds, and 20–35% by weight of Bi, or Bi compounds, for nominal lead equivalent values of up to 0.15 mm, and 40–60% by weight of Sn, or Sn compounds, 15–30% by weight of Bi, or Bi compounds and 0–30% by weight of W, or W compounds, for nominal lead equivalent values of 0.15–0.60 mm.

In a particularly preferred embodiment of the invention, the lead substitute material is characterised in that it has 52–70% by weight of Sn, or Sn compounds, and 21–32% by weight of Bi, or Bi compounds, for nominal lead equivalent values of up to 0.15 mm, and 42–57% by weight of Sn, or Sn compounds, 15– 30% by weight of Bi, or Bi compounds, and 5–27% by weight of W, or W compounds, for nominal lead equivalent values of 0.15–0.60 mm.

The matched combination of tin and bismuth and optionally tungsten, or compounds of these metals, now makes it possible to provide an environmentally friendly lead substitute material which is substantially more lightweight than conventional lead or lead oxide material, and which can substitute for the latter in the energy range of an X-ray tube with a voltage of 60–125 kV. This energy range is the essential range for X-ray diagnosis.

The criterion when substituting for lead is a 10% deviation of the lead equivalent value from the nominal value, as stipulated in DIN 6813. Radiation protection clothing which is made of the substitute material according to the invention can therefore be worn without restrictions in all applications of X-ray diagnosis. This constitutes a substantial advantage over all known lead substitute materials.

In another particularly preferred embodiment of the invention, the lead substitute material is characterised in that it comprises a structure made up of layers with differing composition.

The lead substitute material may comprise a structure made up of at least two layers with differing composition, which are separate or connected together, the layer further away from the body comprising predominantly Sn and the layer(s) near the body comprising predominantly Bi and optionally W.

The invention will be explained in more detail with reference to the following examples and comparative examples.

The measurements of the weight- and energy-related radiation protection effects were based on the IEC 61331-1 standards; particular points to note in this regard are the measurement geometry and the prefiltering mentioned therein for the X-radiation.

The results of the measurements are collated in Table 1 and in FIG. 1.

TABLE 1

Weight per unit area (kg/m$^2$) of the various radiation protection materials, expressed in terms of the absorption by pure lead, under measurement conditions according to IEC 61331-1 as a function of energy.

| Protective material | 60 kV | 80 kV | 100 kV | 125 kV | 150 kV |
|---|---|---|---|---|---|
| Absorption of the primary radiation in % | 97.2 | 89.3 | 80.8 | 74.4 | 69.7 |
| 0.25 mm of pure lead (without matrix) - reference value | 2.83 | 2.83 | 2.83 | 2.83 | 2.83 |
| Lead with matrix | 3.59 | 3.59 | 3.59 | 3.59 | 3.59 |
| Commercially available lead-free material (Optimit R-100A) | 3.46 | 2.88 | 2.96 | 3.63 | 4.41 |
| Commercially available lead-free material (Xenolite ® NL) | 3.79 | 3.09 | 3.20 | 4.13 | 4.51 |
| Lead substitute material according to the invention, with the composition: 15 wt. % matrix, 54 wt. % Sn, 12 wt. % W, 19 wt. % Bi | 2.93 | 2.83 | 2.83 | 3.07 | 3.53 |

Table 1 shows that, for an equal protective effect in the range of 60–125 kV, the lead substitute material according to the invention has the most advantageous weight per unit area of all the lead-free materials.

A radiation protection shield with the nominal lead equivalent value 0.25 mm, made of the novel material, therefore weighs around 21% less than a conventional shield with lead as the protective material.

Figure 1:
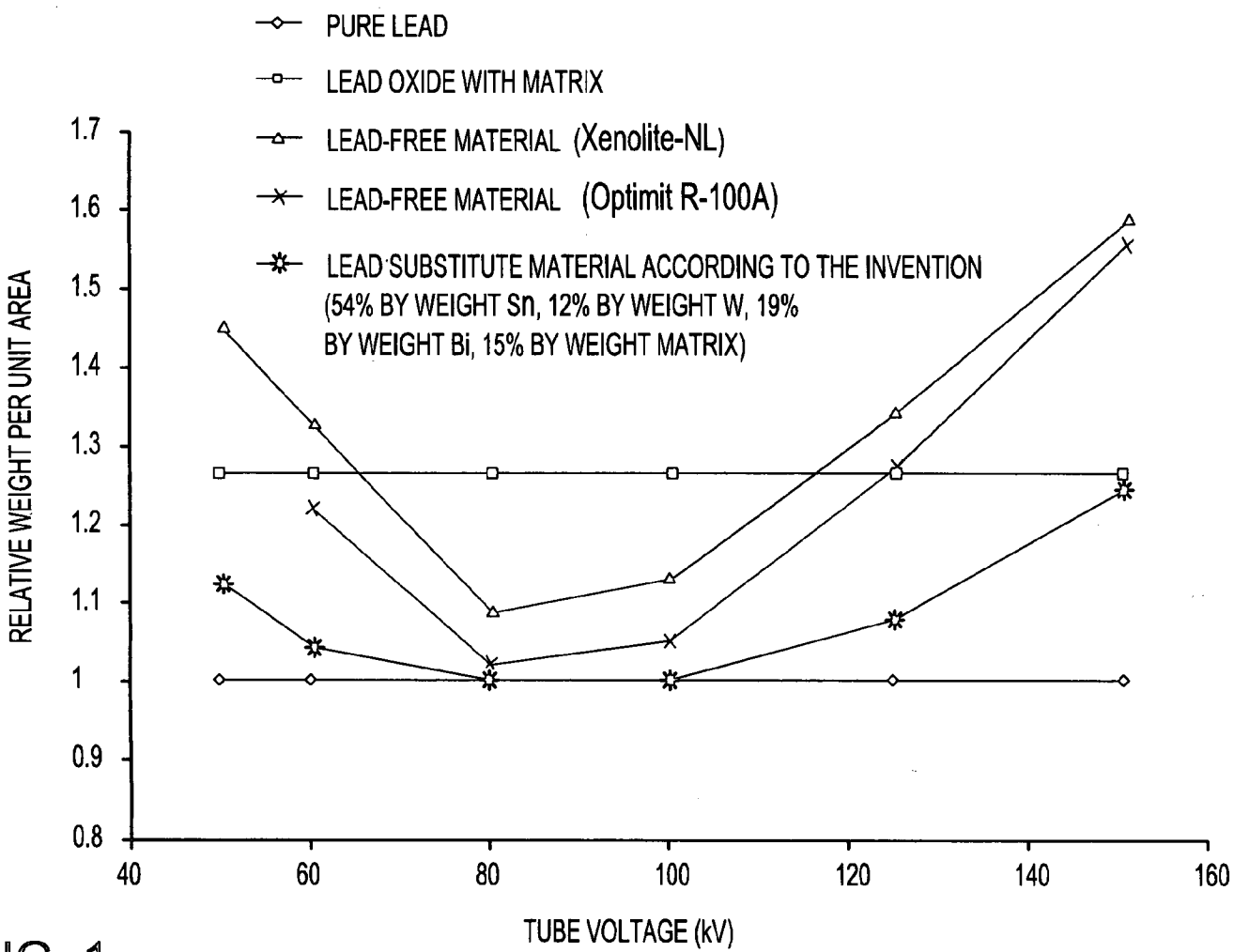
FIG. 1 shows the relative weight per unit area of the various protective materials in Table 1, expressed in terms of the absorption by pure lead in the energy range 50–150 kV.
Figure 2:
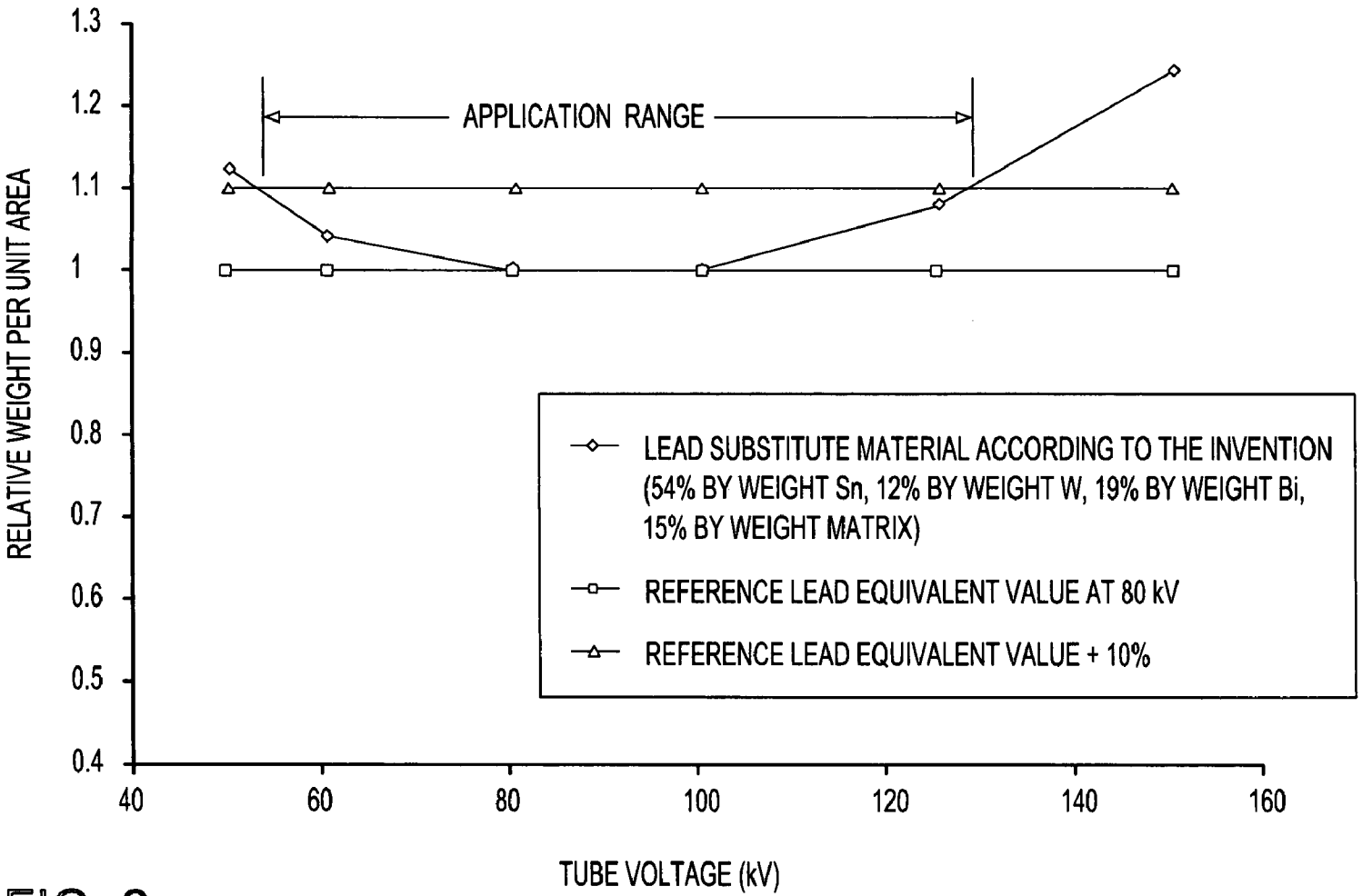
FIG. 2 shows the application range determination of the lead substitute material according to the invention in Table 1, based on a 10% deviation of the lead equivalent value at 80 kV. The determination is carried out according to DIN 6813 and gives an application range of at least 60–125 kV for the material specified.

The measurements which were carried out furthermore show that the radiation-physical properties of the lead substitute material are dependent both on the energy of the incident radiation and on the layer thickness, that is to say the composition of the lead substitute material needs to be modified for each layer thickness, in order to match it to the absorption performance of lead.

The results are shown in Table 2, where the compositions are indicated for conventional lead equivalent values with the corresponding values measured according to IEC 61331-1.

| Nominal lead equivalent value (mm) | Composition M = Matrix material | Weight per unit area (kg/m$^2$) | 60 kV | 80 kV | 100 kV | 125 kV |
|---|---|---|---|---|---|---|
| | | | Beam qualities according to IEC 61331-1 Measured lead equivalent value (mm) | | | |
| 0.025 | 65 wt. % Sn + 22 wt. % Bi + 15 wt. % M | 0.25 | 0.023 | 0.025 | 0.025 | 0.023 |
| 0.05 | 55 wt. % Sn + 30 wt. % Bi + 15 wt. % M | 0.51 | 0.045 | 0.050 | 0.050 | 0.045 |
| 0.125 | 55 wt. % Sn + 30 wt. % Bi + 15 wt. % M | 1.25 | 0.120 | 0.125 | 0.125 | 0.120 |
| 0.25 | 54 wt. % Sn + 12 wt. % W + 19 wt. % Bi + 15 wt. % M | 2.8 | 0.24 | 0.25 | 0.25 | 0.23 |
| 0.35 | 48 wt. % Sn + 20 wt. % W + 17 wt. % Bi + 15 wt. % M | 3.9 | 0.33 | 0.35 | 0.36 | 0.32 |
| 0.05 | 44 wt. % Sn + 25 wt. % W + 16 wt. % Bi + 15 wt. % M | 5.5 | 0.48 | 0.50 | 0.50 | 0.45 |

As can be seen from Table 2, for example, the substitute material comparable with 0.2 mm of lead consists of 15% by weight matrix material, 54% by weight Sn, 12% by weight W and 19% by weight Bi, with a mass per unit area of 2.8 $kg/m^2$ in total. The matrix material is the substrate and may, for example, consist of rubber or latex. Large deviations from the composition according to the invention detrimentally effect either the allowable application range and/or the weight.

If a protective layer with a lead equivalent value of 0.5 mm is required, however, then the composition needs to be modified according to Table 2 in order to achieve the performance corresponding to lead over an energy range of from 60 to 125 kV.

In terms of radiation physics, the embodiment of the invention to which claim 5 relates can make it possible to further reduce the user's radiation exposure. For example, the radiation exposure at an X-ray voltage of 100 kV can be reduced by about 15% if the outer layer consists exclusively of tin and the inner layer consists of bismuth and optionally tungsten. The weight of the protective clothing can advantageously be reduced further by taking this relationship into account.

The invention claimed is:

1. Lead substitute material for radiation protection purposes in the energy range of an X-ray tube with a voltage of 60–125 kV, characterised in that the lead substitute material comprises Sn, Bi and optionally W, or compounds of these metals, and the composition of the lead substitute material is a function of the nominal lead equivalent value.

2. Lead substitute material according to claim 1, characterised in that it comprises 10–20% by weight of a matrix material,
50–75% by weight of Sn, or Sn compounds, and
20–35% by weight of Bi, or Bi compounds,
for nominal lead equivalent values of up to 0.15 mm, and
40–60% by weight of Sn, or Sn compounds,
15–30% by weight of Bi, or Bi compounds, and
0–30% by weight of W, or W, compounds
for nominal lead equivalent values of 0.15–0.60 mm.

3. Lead substitute material according to claim 2, characterised in that it comprises 10–20% by weight of a matrix material,
52–70% by weight of Sn, or Sn compounds, and
21–32% by weight of Bi, or Bi compounds,
for nominal lead equivalent values of up to 0.15 mm, and
42–57% by weight of Sn, or Sn compounds,
15–30% by weight of Bi, or Bi compounds, and
5–27% by weight of W, or W compounds,
for nominal lead equivalent values of 0.15–0.60 mm.

4. Lead substitute material according to any one of the preceding claims, characterised in that it comprises a structure made up of layers with differing composition.

5. Lead substitute material according to claim 4, characterised in that it comprises a structure made up of at least two layers with differing composition, which are separate or connected together, the layer further away from the body comprising predominantly Sn and the layer(s) near the body comprising predominantly Bi and optionally W.

* * * * *